US005417013A

United States Patent [19]

Tillmann

[11] Patent Number: 5,417,013

[45] Date of Patent: May 23, 1995

[54] OVERHEAD DOOR CLOSER WITH SLIDE RAIL FOR CONCEALED INSTALLATION IN DOOR PANELS OR DOOR FRAMES

[75] Inventor: Horst Tillmann, Ennepetal, Germany

[73] Assignee: Dorma GmbH + Co. KG, Ennepetal, Germany

[21] Appl. No.: 89,147

[22] Filed: Jul. 8, 1993

[30] Foreign Application Priority Data

Jul. 10, 1992 [DE] Germany ..... 92 09 276.4 U
Jun. 9, 1993 [DE] Germany ..... 93 08 568

[51] Int. Cl.[6] ..... E05F 3/10

[52] U.S. Cl. ..... 49/386; 16/53; 16/56

[58] Field of Search ..... 49/386; 16/53, 56, 58, 16/60, 49, DIG. 9, 71

[56] References Cited

U.S. PATENT DOCUMENTS 3,174,177 3/1965 Bugge ..... 16/60 X
3,724,023 4/1973 Tillmann ..... 16/53

FOREIGN PATENT DOCUMENTS 0212484 3/1987 European Pat. Off. .
833575 7/1938 France ..... 16/56
2015302 10/1971 Germany .
3345004 6/1985 Germany .
473970 7/1969 Switzerland ..... 16/53
1250621 10/1971 United Kingdom .
1258239 12/1971 United Kingdom .
1270355 4/1972 United Kingdom .
1332780 10/1973 United Kingdom .
a392489 4/1975 United Kingdom .
2052622 1/1981 United Kingdom .
2244759 12/1991 United Kingdom .
2261915 6/1993 United Kingdom .
2268540 1/1994 United Kingdom .

OTHER PUBLICATIONS

Forson Design and Engineering Co., Ltd., brohcure entitled "The Lancer-Door Check and Closer".

*Primary Examiner*—Philip C. Kannan
*Attorney, Agent, or Firm*—Nils H. Ljungman & Associates

[57] ABSTRACT

A door closer having a slide rail linkage and capable of being essentially fully concealed upon installation in either a door panel or door frame, has a housing in which is mounted a closer shaft. The closer shaft has a first end projecting from the housing to be attached to the slide rail linkage, a cam for providing the closing movement of the door, and a second end which is mounted in a journal bearing disposed within the housing.

18 Claims, 3 Drawing Sheets

OVERHEAD DOOR CLOSER WITH SLIDE RAIL FOR CONCEALED INSTALLATION IN DOOR PANELS OR DOOR FRAMES

BACKGROUND OF THE INVENTION

1. Field of the Invention

This invention relates to a door closer with a slide rail linkage, which door closer is capable of being concealed in a door panel or a door frame when installed. Such a door closer may have a closer shaft which can be activated by a spring in the closing direction, as well as a damping piston which interacts with this closer shaft. There may also be a pivoting actuator arm coupled to the closer shaft on one end of the actuator arm. Also, by means of a sliding block, located on the other end of the actuator arm, the actuator arm can be engaged in a slide rail, which slide rail can be installed in the other of the door frame or in the door panel.

2. Background Information

Such a door closer as described above, is shown in a publication of the Lancer Company. This type of door closer has a closer shaft with gear teeth which are engaged with a toothed rack piston, or, in other words, a piston rod with teeth. A major disadvantage of such a closer is that, on account of the use of the toothed rack, it can essentially only be used for one type of installation. Moreover, for reasons relating to the installation, the journal bearing of the closer shaft has been placed outside the housing. Thus, the overall height of the closer is relatively large, which means that the closer cannot be used in framed doors made of aluminum or steel. If door closers which are equipped with a toothed rack piston are used in connection with slide rails, these door closers produce an undesirable increasing torque at the beginning of the opening movement of the door.

This unpleasant effect results from the fact that in the interaction of the slide rail, via the mounting arm, with the toothed section of the toothed rod piston, produces an undesirably large increasing opening moment of resistance. This moment of resistance also increase steadily, thus requiring the application of a constantly increasing force by the user.

German Laid Open Patent Application No. 20 15 302 discloses a door closer which can be installed in a door frame, or can also be installed in a door. This door closer is a tubular body in which there are an axially movable closing piston and a braking piston which interacts with the closing piston. When the door is opened, the spring stretches so that the door can be closed by the force of the spring. The fluid inside the housing damps the closing movement of the door.

An alternative overhead door closer, which is connected with a slide rail, but is not configured for concealed installation is disclosed in German Laid Open Patent Application 33 45 004. This door closer has a closer shaft activated by a spring arrangement to close the door, and a damping piston connected to the closer shaft, as well as a pivoting actuator arm coupled to the closer shaft. This actuator arm is held in a guide rail by means of a slide located on the other end of the actuator arm. To improve the ease of operation of such an overhead door closer with only one actuator arm engaged in a guide rail, the closer shaft has a cam whose curved path corresponding to the opening direction of the door panel is acted on by a spring-assisted element, and whose curved path corresponding to the closing direction of the door panel is acted on by a damping piston.

All the commercially available door closers involving a slide rail installation, and suitable for installation in doors, have their journal bearing outside the housing for reasons related to the installation of the door closer. Only in that way is it possible to install the compression spring and the toothed rack in the housing. Further, the known door closer systems which have a slide rail installation are generally not suitable for installation in both door panels and door frames.

OBJECT OF THE INVENTION

The object of the invention is to create an overhead door closer for installation in door panels or in door frames which can be used both for DIN-right and DIN-left doors, which can also be used with framed doors made of aluminum or another metal, and can offer a desirable ease of operation for the user.

SUMMARY OF THE INVENTION

This object is achieved by a door closer in which the closer shaft preferably has a cam, and, in addition, one end of the closer shaft preferably does not project out of the housing. This end of the closer shaft is preferably located in a journal bearing inside the housing. Further, the cam is preferably designed so that the built-in door closer has a decreasing opening moment of resistance.

An additional embodiment of the invention provides that the curve of the cam surfaces have different radii of curvature, which different radii ultimately make up the profile of the curved path for the cam followers.

Further, in additional embodiments of the invention, the cam can preferably have two symmetrical curves and the spring force of the compression spring acting on the cam surfaces can preferably be continuously adjusted by means of a spring adjustment mechanism.

In other additional embodiments of the invention the journal bearing of the closer shaft end can preferably be located inside the housing between the cylinder chambers of the opening piston and the damping piston, while the side of the housing opposite the side with the projecting portion of the closer shaft can preferably have no projection. Further, the present invention provides a door closer which can preferably be installed in framed doors.

As a result of the use of a cam which has symmetrical curves, as per the present invention, it can be possible to use the door closer both for DIN-right doors and for DIN-left doors, or in other words, doors which are hinged to open either from the right side or the left side. Preferably, an additional important feature of the present invention is the non-projecting lower journal bearing of the closer shaft. The closer shaft bearing has essentially been placed inside the housing, which is essentially made possible because the door closer is preferably equipped with a damping piston and an opening piston, each of which pistons can be inserted from one of the long sides of the housing. Consequently the overall height of the door closer is significantly lower. In addition to the above, the door closer of the present invention can also preferably be installed in door frames. If the door closer were only to be installed within wooden doors, then naturally the relatively high door closer housing would not generally play an important role. But, on the other hand, on framed door panels, for example a glass door panel with a metal or wood frame disposed thereabout, it is desirable that the frees should not be excessively large, thereby allowing the glass area to be maximized. In such circumstances, it is important that the housing of the door closer be of a size which makes it possible to conceal the installation of the door closer inside the frame.

As a result of the symmetrical design of the two curves of the cam, the door closer can achieve the same torque curve in both directions of rotation, which in turn guarantees a uniform damping of the closing movement in both directions. Thus, it could also be possible to use such a door closer on a door panel which opens both inwardly and outwardly.

As a result of its relatively small size, the door closer can thus be installed inside the door, while, further, for framed doors the door closer can be installed inside the door profile. The door closer essentially acts in connection with a slide rail which can be located in the frame located above it, which is in no way unacceptable or disruptive to the user. This type of installation is aesthetically pleasing, and still offers the user the ease of a door with an externally-installed door closer.

Known systems essentially all operate with a pinion and with gear teeth. Such a pinion/gear teeth system typically entails an altogether enormous disadvantage in the operation of a door equipped with such a system, because the opening moment, or torque, that must be applied to the door to open the door increases steadily. In contrast to such known systems, the door closer according to the present invention can preferably use a cam which makes it possible, on account of the configuration of the curves of the cam surfaces, to design the torque curve so that, for example, in the neutral, or closed position, there is a relatively high moment of resistance, or torque, and as the door opened, the moment of resistance, or torque, decrease rapidly, even though the spring force acting on the torque increases linearly.

As a result of the configuration of the profile of the cam surfaces, which surfaces preferably have a series of different radii, it can be possible to increase the closing moment in the neutral position so that the door can overcome the resistance of the lock, and thereby be self-latching, but beyond that does not close with such a high velocity that a person using the door need be concerned about any danger caused by the door possibly closing too fast and hitting the user.

In general, when the cam profile has different radii, the midpoint of the individual radii must be considered to be the line of force, because the force always occurs perpendicular to the cam profile. For example, in the first part of the curve, or just aside from the neutral position, there can preferably be a larger radius than in a further opened position of the door. This larger radius essentially puts the cam surface at a greater distance from the midpoint of the closer shaft, and thus essentially represents a large effective lever arm for the introduction of force. Then the cam curve can preferably make a transition into a next radius, which can enable the cam surface to be closer to the mid-point of the closer shaft. In the area having the smaller radius, a smaller lever arm should result, and simultaneously the force of the compression spring can be increased, even though the total moment of resistance becomes smaller. The above-discussed cam configuration thus can provide a quasi-compensation for the spring force.

In summary, one aspect of the invention features an apparatus for moving a door from a first position to a second position, the door being supported by supporting member device and said apparatus comprising: a housing, the housing being configured for being disposed within one of the door and the supporting member device, the housing having an interior space therein; shaft device, the shaft device having a first portion disposed within the interior space of the housing and a first end extending from the housing, the shaft device having a first position within the housing corresponding to the second position of the door, and the shaft device being rotatable to a second position within the housing upon movement of the door from the second position to the first position; apparatus for rotating the shaft device from the first position to the second position upon movement of the door from the second position to the first position, the apparatus for rotating comprising attachment means connected between the first extending end of the shaft device and the other of the door and the supporting member device; apparatus for returning the shaft device to the first position within the housing from the second position within the housing to move the door from the first position to the second position, the apparatus for returning being disposed within the interior space of the housing; the first portion of the shaft device comprising a second end of the shaft device disposed at an end of the shaft device opposite the first extending end; the housing comprising bearing device disposed within the interior space of the housing; and the second end of the shaft device being mounted in the bearing device in the interior space of the housing.

Another aspect of the invention features an apparatus for moving a door from a first position to a second position, the door being supported by supporting member device and the apparatus comprising: a housing, the housing being configured for being disposed within one of the door and the supporting member device, the housing having an interior space therein; shaft device disposed at least partially within the interior space of the housing and having a first end extending from the housing, the shaft device having a first position within the housing corresponding to the second position of the door, and the shaft device being rotatable to a second position within the housing upon movement of the door from the second position to the first position; apparatus for rotating the shaft device from the first position to the second position upon movement of the door from the second position to the first position, the apparatus for rotating comprising attachment device connected between the first extending end of the shaft device and the other of the door and the supporting member device; apparatus for returning the shaft device to the first position within the housing from the second position within the housing to move the door from the first position to the second position, the apparatus for returning being disposed within the interior space of the housing; the shaft device comprising a cam, the cam comprising at least one cam surface disposed about at least a portion of the circumference of the cam; the door having a moment of resistance resisting movement of the door from the second position to the first position; and the at least one cam surface being configured to provide a decreasing moment of resistance during movement of the door from the second position to the first position.

BRIEF DESCRIPTION OF THE DRAWINGS

The present invention is explained in greater detail below, with reference to embodiments which are schematically illustrated in the accompanying drawings, in which.

DESCRIPTION OF THE PREFERRED EMBODIMENTS

Figure 1:
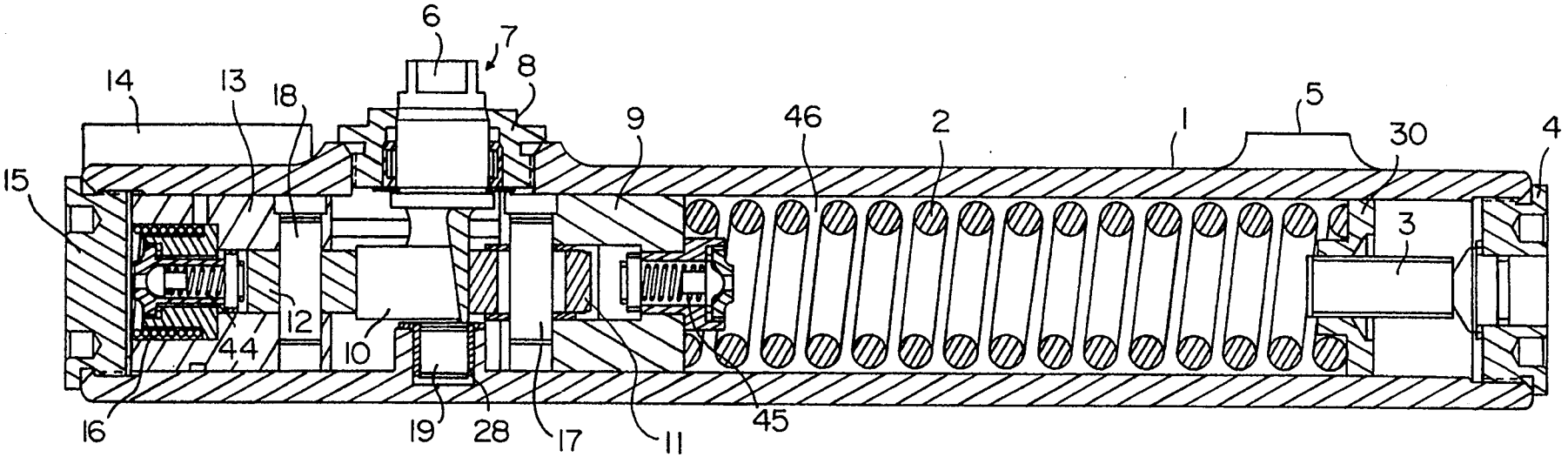
FIG. 1 shows a built-in door closer in longitudinal section.
Figure 3:
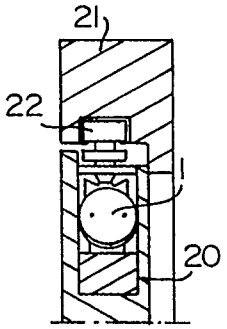
FIG. 3 shows a side view, in cross section along line III—III of the installed door closer of FIG. 2.
Figure 2:
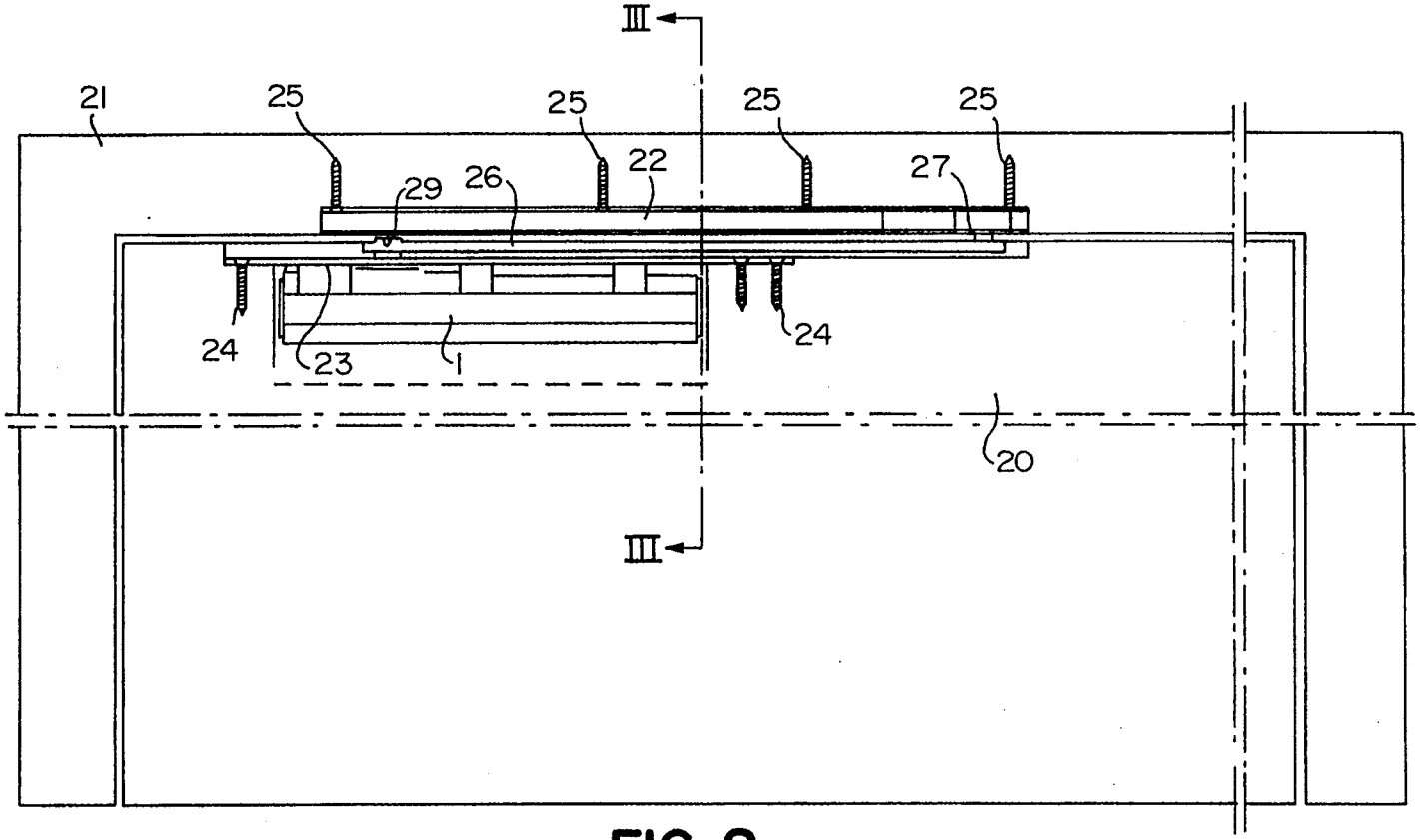
FIG. 2 shows a built-in door closer installed within a door.

FIG. 1 shows the door closer of the present invention with its housing 1 in longitudinal section. Inside the housing 1 is preferably the closer shaft 7, which can project, with its projecting portion 6 out of the housing 1. The closer shaft 7 can preferably be mounted into the housing 1 by means of a closer shaft bearing 8, through which the projecting portion 6 can pass. The other end of the closer shaft 7 can be mounted in a bearing 28 which can also preferably be located inside the housing 1. A cam 10 can preferably be positively connected and force-fitted to the closer shaft 7.

Figure 4:
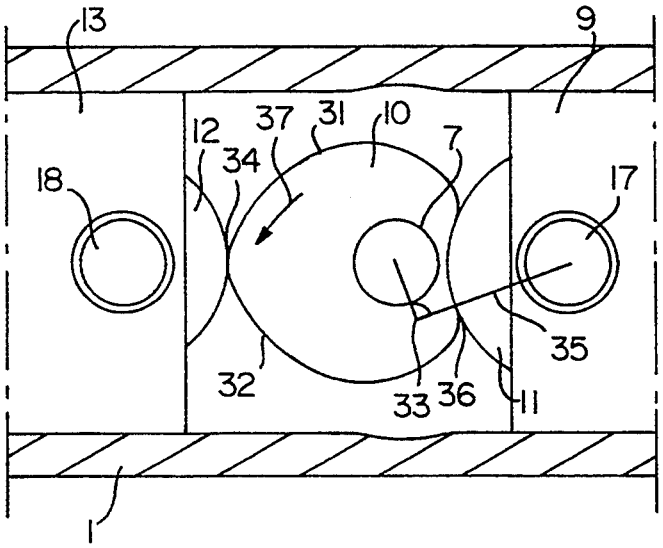
FIG. 4 shows a representative view of a cam and cam followers as could possibly be used by the present invention.

The cam 10 can preferably have two symmetrical curves 31 and 32 about a longitudinal axis of the closer, as shown in FIG. 4. Such a configuration is preferable to thereby enable one configuration of the door closer to be used for both DIN-left and DIN-right doors, so that the door closer preferably applies the same torque in both directions of rotation, and thus also achieves the same opening moment of resistance in either direction. The representation of the cam 10 in FIG. 4 is meant as an example only, and essentially any cam design which provides cam surfaces sufficient to produce a closing torque in response to the cam follower 11 and resilient member 2 (not shown in FIG. 4) may essentially be used within the scope of the present invention. However, if it is desired that the opening torque of the door decreases the further the door is opened, (discussed further herebelow) a configuration similar to that represented in FIG. 4 would preferably be desirable.

Such cams could generally range from an essentially cylindrical cam to more of an oval shaped cam, or heart-shaped cam, as shown in FIG. 4, depending on the desired door closing characteristics. Further, the cam could also have flat areas or notches designed for holding a door in a particular position, such as in a fully opened position, or, as shown, in a fully closed position. By providing two symmetrical surfaces 31 and 32 for the cam 10, the door closer can essentially apply the same torque in both directions of rotation, or in other words, in both an inward direction and an outward direction of rotation of the door. As such, the door closer of the present invention can essentially be used in both: doors hinged on the right hand side thereof; and doors hinged on the left hand side thereof.

Alternatively, the cam could be designed with different curves for each movement direction, thereby applying different torques in each direction if such characteristics are desired. The force transmission rollers 11 and 12, which act as cam followers, are preferably mounted on the axle bolts 17 and 18 and are preferably in contact with the cam 10.

Some examples of cam assemblies used in door closing apparatus can be found in the following U.S. Patents: U.S. Pat. Nos. 4,376,323 to Horst Tillmann, entitled "Automatic Door Closer"; and 4,658,468 and 4,785,493 both to Horst Tillmann and Giselher Sieg, and both entitled "Door Check".

The door closer of the present invention can also preferably have a first, or opening piston 9, and a second, or damping piston 13. The axle bolt 17 can preferably be mounted in the opening piston 9, which can be pressurized by a compression member, such as a spring 2. On the other end, the compression spring 2 can be held by a supporting ring 30. The supporting ring 30 can be located on the spring adjustment mechanism 3. The spring force of the compression spring 2 can preferably be continuously adjusted by means of the spring adjustment mechanism 3. The housing can be closed on the side of the opening piston 9 by the screw plug 4. The spring adjustment mechanism 3 may be a simple bolt arrangement having a bolt which passes through the screw plug 4 and is threaded in the supporting ring 30.

The axle bolt 18 can preferably be located in the opposite damping piston 13 which can be pressurized by a compression member, or spring 16. The spring force of this spring 16 could be, for example, 50% less than the spring force of the compression spring 2. It is also conceivable that, although not shown in the figures, the spring force of the spring 16 could also be adjustable by a mechanism such as that described above for spring 2.

The housing can preferably be closed on the side of the damping piston 13 by a screw plug 15, and the housing could be fluid-filled with fluid 46 to damp the closing movement of the door. There could also therefore be damping valves 44 and 45 for damping fluid flow through the pistons. Further, the housing 1 can preferably have, on an upper side thereof, installation plate fasteners 5 and 14. The installation plate 23 can preferably be fastened onto these installation plate fasteners 5 and 14 by a fastening device, such as by screws. This installation plate 23 can, in turn, be connected by means of additional fastening devices, such as, screw elements 24, either to the door panel 20 or to the door frame 21 depending upon the type of installation in which the closer is being used. The actuator arm 26, which can preferably lie in a recess between the door 20 and the frame 21, and preferably in a recess in the door 20, can preferably be fastened onto the projecting end 6 of the closer shaft 7, by means of the closer shaft fastener 29. The other end of the actuator arm 26 can preferably be mounted with the sliding block fastener 27 in the slide rail 22. The slide rail 22 can then, in turn, be screwed with its fasteners 25 to the door frame 21 located above the door panel 20. The slide rail 22 can also be located in a recess in the door frame 21 as shown, or, in an alternative embodiment, in the door panel 20 when the housing 1 is located in the door frame 21, so that the entire installation of the door closer can either be concealed inside the door frame or inside the door panel.

Because the bearing 28 of the closer shaft 7 can be located inside the housing 1, the overall height of the closer can be reduced. This reduction in size is essentially due to the use of the cam, which enables the mechanism according to the present invention to operate with two pistons, which can preferably be inserted into the housing 1 from the long sides, or in other words, through the longitudinal ends of the housing, after the installation of the closer shaft 7.

FIG. 4 shows an enlarged view of the cam 10. The embodiment of the cam 10 shown in FIG. 4 is essentially configured so that the opening moment, or torque, decreases as the door is opened. In other words, the further the door is moved from its closed position, the lesser the opening moment would become. As can essentially be seen, the radius of curvature essentially can continuously increase from the point of contact 36 to the point or tip of the cam illustrated by the reference number 34. In this embodiment, the radius of curvature approximately doubles, or increases from about 12 mm to about 25 mm.

The illustrated position shown in FIG. 4, essentially shows the door closer in its base or neutral position, or with the tip 34 in contact with the damping roller 18. In other words, the door is closed. In this configuration, or with the door closed, the figure essentially shows that the projected lever arm 33 is at its largest. If the closer shaft 7 were pivoted in the opening direction 37, or in other words, if the door is moved out of its closed position, it can generally be understood that the largest lever arm 33 becomes active. If an imaginary line 35 is drawn through the midpoint of the axle bolt 17, and intersects with the cam 32 at the contact point 36, the effective lever arm 33 would be at a right angle to the line. With the cam configuration shown, this projected lever arm 33 would essentially be largest when the door is in its closed position, which also means that in this position, the greatest moment of resistance prevails against a force rotating the door. If the door is opened farther, a decreasing opening moment of resistance occurs, because the lever arm 33 would become smaller due to the variation in the radius of the cam surfaces. FIG. 4 essentially shows that, as a result of the configuration of the cam surfaces 31 and 32, which should be designed symmetrically if the door closer is to be used for both DIN-right and DIN-left doors, any desired moment of resistance can essentially be generated on account of the different radii of the cam surfaces 31 and 32. Known door closers are typically not capable of providing such flexibility.

Figure 4A:
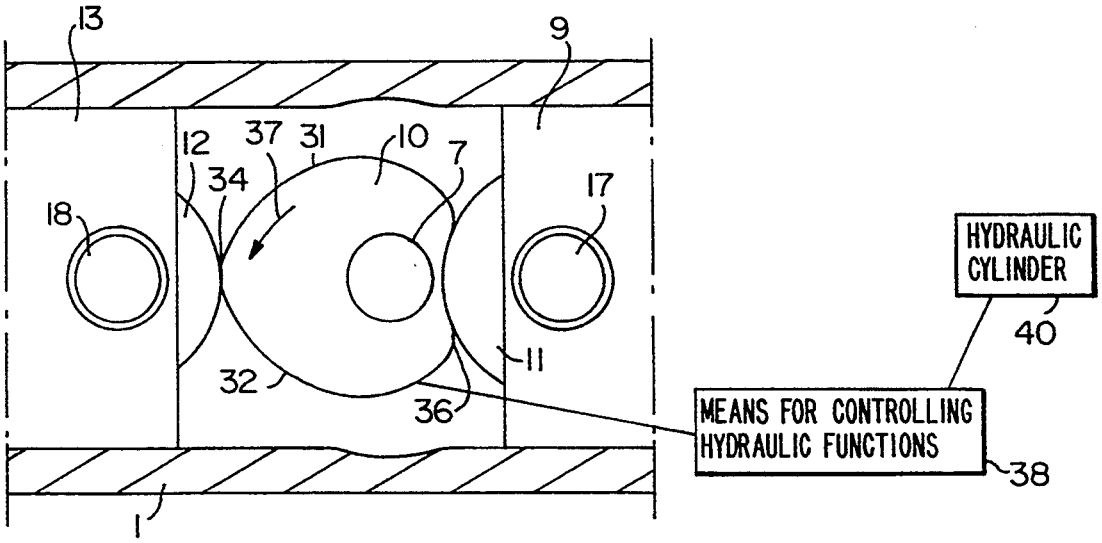
FIG. 4*a* shows a control device for controlling hydraulic functions of the door closer.

The cam 10 and the corresponding cam surfaces 31 and 32 can also generally be adapted to control certain hydraulic function of the built-in door closer by means of the different areas of the cam. Such is schematically represented in FIG. 4*a*. wherein a means for controlling hydraulic functions 38 may preferably be operably connected with cam 10 and a hydraulic cylinder 40 may, in turn, preferably be operably connected with control means 38.

One feature of the invention resides broadly in the overhead door closer with slide rail linkage for concealed installation in door panels or door frames, with a closer shaft which can be activated by a spring in the closing direction, and a damping piston which interacts with this closer shaft, and with a pivoting actuator arm coupled to the closer shaft on one end, which actuator arm is engaged by means of a sliding block located on the other end in a slide rail installed in a door frame or in a door panel, characterized by the fact that the closer shaft 7 has a cam 10, and the end 19 of the closer shaft which does not project out of the housing 1 is mounted in a journal bearing 28 inside the housing 1.

Another feature of the invention resides broadly in the overhead door closer, characterized by the fact that the cam 10 has two symmetrical curves.

Yet another feature of the invention resides broadly in the overhead door closer, characterized by the fact that the spring force of the compression spring 2 can be continuously adjusted by means of the spring adjustment mechanism 3.

Still another feature of the invention resides broadly in the overhead door closer, characterized by the fact that the journal bearing 28 of the closer shaft end 19 is located inside the housing between the cylinder chambers of the opening piston 9 and the damping piston 13.

Another feature of the invention resides broadly in the overhead door closer, characterized by the fact that the side of the housing 1 opposite the side with the projecting portion of the closer shaft 7 has no projection.

Yet another feature of the invention resides broadly in the overhead door closer, characterized by the fact that the overhead door closer can be installed in framed doors.

Further, another feature of the invention resides broadly in a built-in door closed with slide rail linkage for concealed installation in door panels or door frames with a closer shaft which can be activated by a spring in the closing direction, and a damping piston which interacts with this closer shaft, and with a pivoting actuator arm coupled to the closer shaft on one end, which actuator arm is engaged by means of a sliding block located on the other end in a slide rail installed in a door frame or in a door panel, characterized by the fact that the closer shaft is force-fitted and form-fitted to a cam which, on account of its cam curves is designed so that the built-in door closer has a decreasing opening moment of resistance.

Yet another further feature of the invention resides broadly in a built-in door closer characterized by the fact that the profile of the cam curves consists of the combined profile of different radii in series in relation to the closer shaft.

Still yet another further feature of the invention resides broadly in a built-in door closer characterized by the fact that the cam is equipped with two symmetrically-configured cam curves.

Still yet another further additional feature of the invention resides broadly in a built-in door closer characterized by the fact that the cam controls hydraulic functions of the built-in door closer.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings, in their entirety, including all dimensions, proportions and/or shapes in at least one embodiment of the invention, are, if applicable, accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

What is claimed is:

1. Apparatus for moving a door from a first position to a second position, the door being supported by supporting member means and said apparatus comprising:

a housing, said housing being configured for being disposed within one of the door and the supporting member means, said housing having an interior space therein;

shaft means, said shaft means having a first portion disposed within said interior space of said housing and a first end extending from said housing, said shaft means having a first position within said housing corresponding to said second position of the door, and said shaft means being rotatable to a second position within said housing upon movement of the door from said second position to said first position;

means for rotating said shaft means from said first position to said second position upon movement of the door from the second position to the first position, said means for rotating comprising attachment means connected between said first extending end of said shaft means and the other of the door and the supporting member means;

means for returning said shaft means to said first position within said housing from said second position within said housing to move the door from the first position to the second position, said means for returning being disposed within said interior space of said housing;

said first portion of said shaft means comprising a second end of said shaft means disposed at an end of said shaft means opposite said first extending end;

said housing comprising bearing means disposed within said interior space of said housing;

said second end of said shaft means being mounted in said bearing means in said interior space of said housing;

said shaft means further comprises a cam disposed thereabout;

said means for returning comprises:

first cam follower means for being disposed adjacent said cam; and first resilient member means for pressing said first cam follower means against said cam, said first resilient member means being configured for being compressed upon rotation of said shaft means from said first position to said second position;

said cam being configured to compress said first resilient member means upon rotation of said shaft means from said first position to said second position;

a damping piston disposed within said housing, said damping piston comprising second cam follower means disposed adjacent said cam, said second cam follower means being movable independently of said first cam follower means, said damping piston comprising second resilient member means for pressing said second cam follower means against said cam, said second resilient member means being configured for being compressed upon rotation of said shaft means from said second position to said first position;

said cam being configured to compress said second resilient member means upon rotation of said shaft means from said second position to said first position;

said first cam follower means comprises a first roller for rotatably engaging said cam, said first roller comprising a sole roller in said first cam follower means; and said second cam follower means comprises a second roller for rotatably engaging said cam, said second roller comprising a sole roller in said second cam follower means.

2. The apparatus according to claim 1, wherein:

the other of said door and said supporting member means comprises rail means;

said attachment means comprises arm means, said arm means having a first end for being connected to said first extending end of said shaft means, and a second end, said second end being disposed opposite said first end, and said second end comprising slide means;

said slide means being configured for sliding along said rail means upon movement of the door between said first position and said second position; and said rail means being configured for guiding said slide means during movement of the door between said first position and said second position.

3. The apparatus according to claim 2, wherein:

said cam has an axis of symmetry; and said cam comprises a first cam surface and a second cam surface disposed on opposite sides of the axis of symmetry, said first cam surface being symmetrical to said second cam surface about the axis of symmetry; and said cam followers being configured for contacting said first and second cam surfaces.

4. The apparatus according to claim 3, wherein:

said first resilient member means is configured for providing a force for pressing said first cam follower against said cam; and said apparatus further comprises means for adjusting the force of said first resilient member means in pressing said first cam follower against said cam.

5. The apparatus according to claim 4, wherein:

said housing defines a longitudinal axis;

said housing comprises a first chamber, a second chamber adjacent said first chamber, and a third chamber adjacent said second chamber, said first, second and third chambers being aligned along said longitudinal axis of said housing;

said first cam follower being disposed in said first chamber, said shaft means and said bearing means being disposed in said second chamber, and said second cam follower being disposed in said third chamber.

6. The apparatus according to claim 5, wherein:

the housing has a first end adjacent said first chamber, a second end adjacent said third chamber, a first side extending from said first end to said second end and a second side extending from said first end to said second end, said second side being opposite said first side;

said first side having an opening therein adjacent said second chamber, said first extending end of said shaft means passing through said opening and projecting out of said housing;

said second side having no projections thereon; and said apparatus is configured for being installed in framed doors.

7. The apparatus according to claim 1, wherein:

the door has a top, a bottom disposed opposite to the top, a first edge extending from the top to the bottom, and a second edge extending from the top to the bottom and opposite the first edge, the top of the door has a slot therein, and said housing being configured to be disposed within said slot of the door;

the supporting member means comprises a frame disposed adjacent at least the top portion of the door;

the door being configured to pivot with respect to the frame to pivot the door between a closed position with the door disposed substantially adjacent the frame and an open position with the door disposed angularly with respect to the frame;

said second position of the door comprises the closed position;

said first position of the door comprises the open position;

said door having a moment of resistance during pivoting of the door from at least the closed position to the open position;

said door being configured to be pivoted from the closed position to the open position upon application of a force to the door to overcome the moment of resistance; and said cam being configured to provide a decreasing moment of resistance as said door is pivoted from the closed position to the open position.

8. The apparatus according to claim 7, wherein:

said supporting member means comprises rail means, the rail means being disposed on said supporting member means along one of: the top of the door, and the frame disposed adjacent the top of the door;

said attachment means comprises arm means, said arm means having a first end for being connected to said first extending end of said shaft means, and a second end, said second end being disposed opposite said first end, and said second end comprising slide means;

said slide means being configured for sliding along said rail means upon movement of the door between said open position and said closed position; and said rail means being configured for guiding said slide means upon movement of the door between said open position and said closed position.

9. The apparatus according to claim 8, wherein:

the door has a recess disposed along the top of the door;

said arm means being configured for being disposed within the recess when said door is in the closed position for concealment of the arm means therein; and said apparatus is configured for selectively being installed in either of:

a door pivotally mounted along the edge; and a door pivotally mounted along the second edge thereof.

10. The apparatus according to claim 9, wherein:

said housing defines a longitudinal axis;

said housing comprises a first chamber, a second chamber adjacent said first chamber, and a third chamber adjacent said second chamber, said first cam follower being disposed in said first chamber, said shaft means and said bearing means being disposed in said second chamber, and said second cam follower being disposed in said third chamber; and said first cam follower, said shaft means and said second cam follower being disposed in alignment along said longitudinal axis of said housing.

11. The apparatus according to claim 10, wherein:

said cam has an axis of symmetry, said axis of symmetry of said cam being configured to be disposed in alignment with said longitudinal axis of said housing when said shaft means is in said first position;

said cam comprises a first cam surface and a second cam surface disposed on opposite sides of the axis of symmetry, said first cam surface being symmetrical to said second cam surface about the axis of symmetry; and said cam followers being configured for contacting said first and second cam surfaces for moving said door from said open position to said closed position for both of:

a door pivotally mounted along the first side thereof; and a door pivotally mounted along the second side thereof.

12. The apparatus according to claim 11, wherein:

said shaft means defines an axis of rotation of said cam, said axis of rotation being disposed adjacent said first cam follower;

said cam comprises a first end disposed adjacent said first cam follower and a second end disposed opposite to said first end, said first end of said cam having a groove for receipt of said first cam follower therein, and said second end forms a point disposed in a direction away from said groove and towards said second cam follower;

said first and second cam surfaces extending from said first end to said second end of said cam;

said cam having a radius of curvature from said axis of rotation to each of said first and second cam surfaces;

said radius of curvature increasing along each of said first and second cam surfaces from said groove to said point;

said first resilient member means is configured to apply a first bias pressure for pressing said first cam follower against said cam; and said apparatus further comprises means for adjusting the first bias pressure of said first resilient member means.

13. The apparatus according to claim 12, wherein:

said housing comprises a tubular housing;

said apparatus further comprises a second piston disposed in said first housing chamber, said second piston comprising said first cam follower and said first resilient member means;

said first roller is rotatably mounted on said second piston;

said second roller is rotatably mounted on said damping piston;

said damping piston and said second piston comprising means for rotatably mounting said first and second rollers thereon;

said housing has a first end adjacent said first chamber and a second end adjacent said third chamber, said first and second ends being disposed at opposite ends of said longitudinal axis of said housing;

said housing comprises a first removable end cap disposed at said first end and a second removable end cap disposed at said second end;

said damping piston, said second piston, and said housing being configured for insertion of said damping piston into said housing through said second end and insertion of said second piston into said housing through said first end.

14. The apparatus according to claim 13, wherein:

said first resilient member means comprises first spring means and said second resilient member means comprises second spring means;

said first spring means being configured to bias said first cam follower against the cam with said first bias pressure and said second spring means being configured to bias said second cam follower against the cam with a second bias pressure, said first bias pressure being at least about 50 percent greater than said second bias pressure;

said housing contains a fluid in said housing interior space;

said damping piston has a first side disposed adjacent said second chamber and a second side disposed towards said second end of said housing;

said damping piston comprising valve means for damping flow of the fluid between the first side and the second side of the damping piston;

said second piston has a first side disposed adjacent said second chamber and a second side disposed towards said first end of said housing;

said second piston comprising valve means for damping flow of the fluid between the first side and the second side of the second piston;

said means for adjusting the first bias pressure comprises:

a slidable plate disposed adjacent said first end of said housing, said first spring means being disposed between said slidable plate and said second piston means;

a threaded bolt passing through said first end cap and being threaded into said slidable plate;

said housing comprises means for attaching said housing to said one of: the door and the supporting member means;

said damping piston comprises a slot therein configured for receipt of said second roller;

said second piston comprises a slot therein configured for receipt of said first roller;

said means for rotatably mounting said first roller and said second roller on said second piston and said damping piston comprise bolts axially disposed through said rollers and maintaining said rollers in said slots; and said first removable end cap and said second removable end cap comprise threaded plugs and said first and second ends of said housing comprises corresponding threaded portions configured for receipt of said threaded plugs therein.

15. Apparatus for moving a door from a first position to a second position, the door being supported by supporting member means and said apparatus comprising:

a housing, said housing being configured for being disposed within one of the door and the supporting member means, said housing having an interior space therein;

shaft means disposed at least partially within said interior space of said housing and having a first end extending from said housing, said shaft means having a first position within said housing corresponding to said second position of the door, and said shaft means being rotatable to a second position within said housing upon movement of the door from said second position to said first position;

means for rotating said shaft means from said first position to said second position upon movement of the door from the second position to the first position, said means for rotating comprising attachment means connected between said first extending end of said shaft means and the other of the door and the supporting member means;

means for returning said shaft means to said first position within said housing from said second position within said housing to move the door from the first position to the second position, said means for returning being disposed within said interior space of said housing;

said shaft means comprising a cam, said cam comprising at least one cam surface disposed about at least a portion of the circumference of said cam;

said means for returning comprises:

first cam follower means for being disposed adjacent said cam, said first cam follower means comprising a first roller for rotatably engaging said at least one cam surface at an engagement location, said first roller comprising a sole roller of said first cam follower means; and first resilient member means for pressing said first roller against said cam, said first resilient member means being configured for being compressed upon rotation of said shaft means from said first position to said second position, said first resilient member means applying a first pressure on said first roller;

said at least one cam surface being configured to compress said first resilient member means upon rotation of said shaft means from said first position to said second position;

damping piston means disposed within said housing, said damping piston means comprising second cam follower means disposed adjacent said cam, said second cam follower means being movable independently of said first cam follower means, said damping piston comprising second resilient member means for pressing said second cam follower means against said cam, said second resilient member means being configured for being compressed upon rotation of said shaft means from said second position to said first position, said second resilient member means applying a second pressure on said second cam follower;

said at least one cam surface being configured to compress said second resilient member means upon rotation of said shaft means from said second position to said first position;

said first pressure of said first resilient member for pressing said first roller into engagement with said cam being substantially greater than said second pressure of said second resilient member means for pressing said second cam follower means into engagement with said cam;

said door having a moment of resistance resisting movement of the door from the second position to the first position; and said at least one cam surface being configured to provide a decreasing moment of resistance during movement of the door from said second position to said first position.

16. The apparatus according to claim 15, wherein:

said shaft means comprises an axis of rotation of said cam;

said cam having a radius of curvature from said axis of rotation to said at least one cam surface; and said radius of curvature being variable along said at least one cam surface.

17. The apparatus according to claim 16, wherein:

said cam has a first side and a second side, the first and second sides being disposed on opposite sides of said shaft means;

said at least one cam surface comprises two cam surfaces, one of said two cam surfaces being disposed on each of said first and said second sides of said cam; and said first side surface being symmetrical to said second side surface.

18. The apparatus according to claim 17, wherein:

said housing comprises a hydraulic cylinder;

said first cam follower means comprises piston means of said hydraulic cylinder, said piston means having a first side disposed adjacent said cam, and a second side disposed opposite the first side, and said piston means comprising valve means for controlling flow of hydraulic fluid through said piston means;

said piston means comprising means for rotatably mounting said first roller thereon;

said second cam follower comprises a second roller rotatably mounted on said damping piston means for rotatably engaging said cam surfaces at a position on said cam surface substantially opposite to the engagement position of said first roller, said second roller comprising a sole roller of said second cam follower means; and said cam being configured for controlling hydraulic functions of the hydraulic cylinder.

* * * * *

UNITED STATES PATENT AND TRADEMARK OFFICE

CERTIFICATE OF CORRECTION

PATENT NO. : 5,417,013
DATED : May 23, 1995
INVENTOR(S) : Horst TILLMANN

It is certified that error appears in the above-indentified patent and that said Letters Patent is hereby corrected as shown below:

On the title page, item [56], under the "FOREIGN PATENT DOCUMENTS" section, after the 1332780 reference, delete "a392489" and insert --1392489--.

On the title page, item [56], under the "OTHER PUBLICATIONS" section, after 'Ltd.,', delete "brohcure" and insert --brochure--.

In column 2, line 68, after 'the', delete "frees" and insert --frames--.

Signed and Sealed this

Twenty-first Day of January, 1997

*Attest:*

Bruce Lehman

BRUCE LEHMAN

*Attesting Officer*

*Commissioner of Patents and Trademarks*